US008997294B2

(12) United States Patent
Spencer

(10) Patent No.: US 8,997,294 B2
(45) Date of Patent: Apr. 7, 2015

(54) BROOM SWEEPER APPARATUS, SYSTEMS AND METHODS OF USING THE SAME

(71) Applicant: Eileen Patricia Spencer, Cleadon (GB)

(72) Inventor: Eileen Patricia Spencer, Cleadon (GB)

( * ) Notice: Subject to any disclaimer, the term of this patent is extended or adjusted under 35 U.S.C. 154(b) by 0 days.

(21) Appl. No.: 14/138,212

(22) Filed: Dec. 23, 2013

(65) Prior Publication Data

US 2014/0196226 A1 Jul. 17, 2014

Related U.S. Application Data

(60) Provisional application No. 61/748,200, filed on Jan. 2, 2013.

(51) Int. Cl.

| | |
|---|---|
| ***A47L 11/24*** | (2006.01) |
| ***A47L 11/33*** | (2006.01) |
| ***B08B 1/04*** | (2006.01) |
| ***A46B 15/00*** | (2006.01) |
| ***A46B 11/00*** | (2006.01) |
| ***A46B 13/00*** | (2006.01) |
| ***A46B 13/02*** | (2006.01) |

(52) U.S. Cl.

CPC ..... *A46B 15/0055* (2013.01); *A47L 11/24* (2013.01); *A47L 11/33* (2013.01); *B08B 1/04* (2013.01); *A46B 11/00* (2013.01); *A46B 13/001* (2013.01); *A46B 13/02* (2013.01); *A46B 2200/302* (2013.01); *A46B 2200/3026* (2013.01); *A46B 2200/3033* (2013.01)

(58) Field of Classification Search

CPC ..... A47L 11/24; A47L 11/33; B08B 1/04
USPC ..... 15/4, 42, 83, 106, 79.2; 134/6
See application file for complete search history.

(56) References Cited

U.S. PATENT DOCUMENTS

| | | | | |
|---|---|---|---|---|
| 1,129,118 | A * | 2/1915 | Pereira | 15/42 |
| 3,594,841 | A * | 7/1971 | Kieves | 15/4 |
| 4,028,765 | A | 6/1977 | Liebscher | |
| 4,942,639 | A * | 7/1990 | Shishido et al. | 15/83 |
| 5,432,976 | A * | 7/1995 | Alazet | 15/344 |
| 5,617,610 | A | 4/1997 | Dearaujo | |
| 5,638,572 | A | 6/1997 | Canni | |
| 5,722,112 | A | 3/1998 | Scanni et al. | |
| 5,839,158 | A | 11/1998 | Schupp et al. | |
| 6,029,311 | A | 2/2000 | Scanni et al. | |
| 6,125,500 | A | 10/2000 | Kat | |
| 6,536,075 | B1 | 3/2003 | Bonnet et al. | |

(Continued)

FOREIGN PATENT DOCUMENTS

| | | |
|---|---|---|
| DE | 102005025078 A1 | 10/2005 |
| DE | 102005025078 A1 | 10/2006 |

OTHER PUBLICATIONS

International Search Report and Written Opinion; PCT/IB2014/062799; Dec. 12, 2014.

*Primary Examiner* — Randall Chin

(74) *Attorney, Agent, or Firm* — Scherrer Patent & Trademark Law, P.C.; Stephen T. Scherrer; Monique A. Mornevoit

(57) ABSTRACT

The present invention relates to a broom sweeper apparatus and related embodiments. Specifically, the present invention relates to a broom and/or broom attachment apparatus that provides a debris collection mechanism for quickly, easily and efficiently removing and holding a pile of debris swept into said pile by the broom. Systems and methods of using the same are further provided.

20 Claims, 3 Drawing Sheets

(56) References Cited

U.S. PATENT DOCUMENTS

| | | | | |
|---|---|---|---|---|
| 7,152,267 | B2 | 12/2006 | Kaleta | |
| 7,631,387 | B2 * | 12/2009 | Sclafani et al. | 15/41.1 |
| 7,707,683 | B2 | 5/2010 | Nurudeen | |
| 7,861,351 | B2 | 1/2011 | Ho | |
| 8,020,236 | B2 | 9/2011 | Kaleta et al. | |
| 8,230,540 | B1 | 7/2012 | Nelson | |
| 2004/0111826 | A1 | 6/2004 | Grey | |
| 2005/0235440 | A1 | 10/2005 | Rosenzweig | |
| 2012/0216366 | A1 * | 8/2012 | Chow | 15/339 |
| 2013/0047368 | A1 | 2/2013 | Tran | |

* cited by examiner

BROOM SWEEPER APPARATUS, SYSTEMS AND METHODS OF USING THE SAME

The present invention claims priority to U.S. Provisional Patent Application No. 61/748,200 entitled "Broom Sweeper Apparatus, Systems And Methods Of Using The Same," filed Jan. 2, 2013, which is incorporated herein by reference in its entirety.

TECHNICAL FIELD

The present invention relates to a broom sweeper apparatus and related embodiments. Specifically, the present invention relates to a broom and/or broom attachment apparatus that provides a debris collection mechanism for quickly, easily and efficiently removing and holding a pile of debris swept into said pile by the broom. Systems and methods of using the same are further provided.

BACKGROUND

It is, of course, generally known to sweep debris, such as dust and/or other material with the use of a broom. In fact, an instrument for sweeping dust, debris and other like material, has been used for hundreds, if not thousands, of years, and typically consists of a pole having a plurality of bristles attached to an end thereof, the bristles utilized for sweeping the dust, debris and other like material into a pile.

Typically, once the dust, debris or other like material is swept into a pile, the pile may be removed, or placed into a trash receptacle, or swept outside, or the like. A common instrument used to aid in the removal of the pile of dust, debris and other like material, is a dustpan. A dustpan typically includes a flat scoop or ramped portion, where the pile of dust, debris and/or other like material may be swept thereinto. The dustpan is typically handheld, by holding a handle with the flat scoop or ramped portion disposed adjacent the pile at an angle. A separate broom or brush may be used to push the pile into the dustpan for removal thereof.

Alternatively, the pile of dust, debris or other like material may simply be swept outdoors, or, in some non-hygienic cases, swept underneath other articles, such as under a rug.

While it may be relatively easy to sweep an area using a broom to form a pile of dust, debris or other like material, it is typically quite difficult to actually remove that pile without causing addition mess, or without having to contort one's body into uncomfortable positions to do so. Specifically, when sweeping a pile of dust, debris or other like material into a dustpan, it may be very difficult to remove all of the material from the floor into the dustpan. Specifically, if the pile is too large, then the dustpan may not have sufficient space to hold the entirety of the pile.

In addition, it may be difficult to remove all of the pile because the dustpan may have difficulty having its floor-contacting edge disposed against the floor, preventing dust, debris or other like material from getting caught on or under the floor contacting edge of the dustpan. Put another way, it may be difficult for a user to press the floor-contacting edge of the dustpan with sufficient force against the ground to minimize or otherwise prevent a line of dust, debris or other like material from remaining on the floor after the pile is swept into the dustpan using a broom or brush. In many cases, a user may have to re-sweep the residual dust, debris or other like material into another pile and then attempt to sweep it into the dustpan.

Moreover, it may be difficult to hold both the dustpan and the broom at the same time, and utilize the broom to sweep the dust, debris or other like material into the dustpan without requiring help from another person. To help, a smaller brush may be utilized, but it still may be difficult for a single individual to manipulate both the dustpan and the brush to remove the pile of dust, debris or other like material.

Moreover, a user of a dustpan typically must bend down or otherwise place himself or herself very low and close to the ground to properly manipulate the same for removal of the pile. Many individuals suffer back and leg problems that may make this action particularly difficult. Thus, a user may have to contort his or her body into a position that may, at the least, be very uncomfortable, but at the most may be physically impossible.

Another option is to remove the pile of dust, debris or other like material using a separate vacuum cleaning or other like apparatus. However, it may be time-consuming and difficult to utilize the vacuum cleaner or other like apparatus to perform such a task. The broom would have to be set down or out of the way, and the vacuum cleaner or other like apparatus would be required to be fetched and utilized. Vacuum cleaners are typically large, bulky and utilize a great deal of electrical power, making them impractical and not environmentally friendly.

Electric sweepers are further known, but again, like vacuum cleaners, a separate apparatus is required to take advantage of the sweeping mechanism of the electric sweepers. Moreover, electric sweepers typically must be plugged into a wall, making them impractical for use, or difficult to use, especially in locations far from a plug receptacle. In addition, battery powered electrical sweepers typically utilize heavy rechargeable batteries, adding significant weight to the machine, contributing to its difficulty to use.

Additionally, handheld cleaners are known but have thumb switches for turning the handheld cleaner on or off. When handheld cleaners are used, generally, a user turns the device on and then adjusts the device accordingly to pick up dust, debris and other materials. The entire handheld cleaner may be adjusted, or just a swiveling head may be adjusted. A user may be wasting excess energy with the handheld device on without it being properly adjusted to pick up the dust, debris and other materials. A need exists for a broom sweeper apparatus, systems and methods of using the same that saves energy.

A need, therefore, exists for a broom sweeper apparatus, systems and methods of using the same allowing for the easy removal of a pile of dust, debris or other like material that is swept into the pile using a broom. A need further exists for a broom sweeper apparatus, systems and methods of using the same allowing for the removal of the pile of dust, debris or other like material without requiring manipulation of a dustpan or other like removal apparatus.

In addition, a need exists for a broom sweeper apparatus, systems and methods of using the same that may allow for the full removal of the pile of dust, debris or other like material, without leaving residue behind. Moreover, a need exists for a broom sweeper apparatus, systems and methods of using the same without requiring uncomfortable or physically impossible physical contortion for holding a dustpan to remove the pile of dust, debris or other like material.

Further, a need exists for a broom sweeper apparatus, systems and methods of using the same that may be electrically powered to provide sufficient force for the complete removal of the pile of dust, debris or other like material. Still further, a need exists for a broom sweeper apparatus, systems and methods of using the same that provides sufficient storage for a pile of dust, debris or other like material until the apparatus can be emptied in a trash receptacle or the like.

SUMMARY OF THE INVENTION

The present invention relates to a broom sweeper apparatus and related embodiments. Specifically, the present invention relates to a broom and/or broom attachment apparatus that provides a debris collection mechanism for quickly, easily and efficiently removing and holding a pile of debris swept into said pile by the broom. Systems and methods of using the same are further provided.

To this end, in an embodiment of the present invention, a broom sweeper apparatus is provided. The broom sweeper apparatus comprises a broom having a handle, disposed on the handle being a plurality of bristles for sweeping dust, debris or other like material into a pile; and a debris collection mechanism comprising a base attached to the broom at a location above the bristles, the base comprising at least one rotatable brush disposed on an end of the base, wherein engagement of the rotatable brush to the floor allows the rotating brush to remove the dust, debris or other like material into a receptacle, the receptacle disposed above the base for holding the dust, debris or other like material.

In an embodiment of the present invention, a sweeper apparatus is provided. The sweeper apparatus comprises: a base having a plurality of bristles extending from a bottom of the base for sweeping material into a pile; and a debris collection mechanism disposed on a top of the base, comprising at least one rotatable brush disposed on a first end of the base and a material retaining compartment disposed adjacent the at least one rotatable brush; wherein engagement of the at least one rotatable brush to a surface allows the at least one rotating brush to move material into the material retaining compartment.

In an embodiment, the sweeper apparatus further comprises a handle detachably connected to the top of the base.

In an embodiment, the handle is rotatable.

In an embodiment, the at least one rotatable brush is operated by a motor.

In an embodiment, the motor is powered by batteries.

In an embodiment, the sweeper apparatus further comprises a motor switch disposed on the debris collection mechanism that operates the motor when the motor switch contacts the surface.

In an embodiment, the sweeper apparatus further comprises a motor switch disposed on the debris collection mechanism that initiates the motor when the motor switch is angled towards the surface.

In an embodiment, the sweeper apparatus further comprises a ramp disposed beneath the at least one rotatable brush.

In an embodiment, the ramp is capable of contacting the surface and directing the material into the material retaining compartment.

In an embodiment, the ramp is capable of preventing material from leaving the material retaining compartment.

In an embodiment, the sweeper apparatus further comprises a cover disposed around the at least one rotatable brush.

In an embodiment, the cover comprises an entrance, an exit, and an interfering ridge extending inwardly from one end of the entrance that partially impedes the rotation of the at least one rotatable brush.

In an embodiment, the sweeper apparatus further comprises an openable cover that encloses the material retaining compartment.

In an alternate embodiment of the present invention, a method of cleaning is provided. The method comprises the steps of: providing a sweeper apparatus having a base with a plurality of bristles extending from a bottom of the base, and a debris collection mechanism disposed on a top of the base, comprising at least one rotatable brush disposed on a first end of the base and a material retaining compartment disposed adjacent the at least one rotatable brush; providing material; sweeping the material with the plurality of bristles to a location on a surface; and positioning the at least one rotatable brush atop the location.

In an embodiment, the method further comprises the step of: using the at least one rotatable brush to move the material into the material retaining compartment.

In an embodiment, the at least one rotatable brush is operated by a motor that initiates when angled, and further comprises the steps of: angling the debris collection mechanism toward the surface; and moving the at least one rotatable brush along the surface, such that the material is moved into the material retaining compartment by the at least one rotatable brush.

In an embodiment, the at least one rotatable brush is operated by a motor that initiates when a switch contacts the surface, and further comprises the steps of: contacting the surface with the switch; and moving the at least one rotatable brush along the surface, such that the material is moved into the material retaining compartment by the at least one rotatable brush.

In an embodiment, the material retaining compartment is openably enclosed, and further comprises the steps of: opening the material retaining compartment; and emptying the material retaining compartment.

In an embodiment, the sweeper apparatus further comprises a detachable handle, and further comprises the steps of: attaching the detachable handle to the base of the sweeper apparatus; and using the handle to manipulate the sweeper apparatus.

In an embodiment, the detachable handle is rotatable, and further comprises the step of: rotating the handle.

It is, therefore, an advantage and objective of the present invention to provide a broom sweeper apparatus, systems and methods of using the same allowing for the easy removal of a pile of dust, debris or other like material that is swept into the pile using a broom.

It is a further advantage and objective of the present invention to provide a broom sweeper apparatus, systems and methods of using the same allowing for the removal of the pile of dust, debris or other like material without requiring manipulation of a dustpan or other like removal apparatus.

In addition, it is an advantage and objective of the present invention to provide a broom sweeper apparatus, systems and methods of using the same that may allow for the full removal of the pile of dust, debris or other like material, without leaving residue behind.

Moreover, it is an advantage and objective of the present invention to provide a broom sweeper apparatus, systems and methods of using the same without requiring uncomfortable or physically impossible physical contortion for holding a dustpan to remove the pile of dust, debris or other like material.

Further, it is an advantage and objective of the present invention to provide a broom sweeper apparatus, systems and methods of using the same that may be electrically powered to provide sufficient force for the complete removal of the pile of dust, debris or other like material.

Still further, it is an advantage and objective of the present invention to provide a broom sweeper apparatus, systems and methods of using the same that provides sufficient storage for a pile of dust, debris or other like material until the apparatus can be emptied in a trash receptacle or the like.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a broom sweeper apparatus and related embodiments. Specifically, the present invention relates to a broom and/or broom attachment apparatus that provides a debris collection mechanism for quickly, easily and efficiently removing and holding a pile of debris swept into said pile by the broom. Systems and methods of using the same are further provided.

Figure 1:
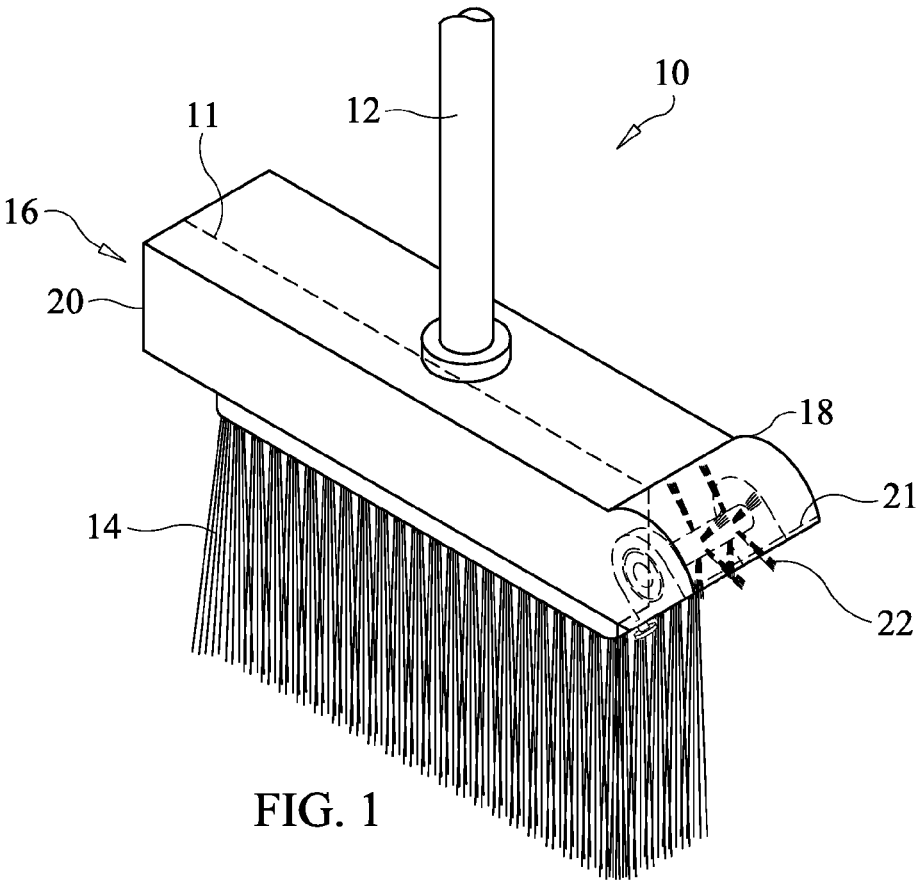
FIG. 1 illustrates a perspective view of a broom apparatus in an embodiment of the present invention.

Now referring to the figures, wherein like numerals refer to like parts, FIG. 1 illustrates a broom apparatus 10 in accordance with the present invention. Specifically, the broom apparatus 10 comprises a broom handle 12 for holding the broom apparatus 10 and using the same for sweeping and removing dust and debris, as described herein. Moreover, the broom apparatus 10 comprises a set of bristles 14 utilized for sweeping dust, debris and other materials, such as in the normal operation of a traditional broom. Disposed above the bristles 14 and below the handle 12 may be a debris removal apparatus 16.

The debris removal apparatus 16 may be utilized to remove dust, debris and other materials from a floor or other surface. More specifically, in a preferred embodiment of the present invention, the broom apparatus 10 may be utilized to sweep dust, debris and other materials on a floor or other surface into a pile, as one would normally use a broom. The debris removal apparatus 16 may then be used to remove the pile of dust, debris and other material quickly and easily in the manner specified below with respect to FIGS. 2-6. The debris removal apparatus may then be emptied for continual use of the same. The debris removal apparatus 16, specifically, has a first end 18 and a second end 20, and further comprises a rotating brush 22 disposed on the first end 18 of the debris removal apparatus 16. The debris removal apparatus 16 may have multiple chambers separated by at least a wall 11.

The rotating brush 22 may rotate via power generated by a set of batteries stored within the debris removal apparatus 16, as illustrated below. Of course, the rotating brush may be powered via a power cord, rechargeable battery, or other power source known to one skill in the art, although it is preferred to operate via a battery pack, more preferably a rechargeable battery pack. When in use, the user activates the rotating brush 22 on the first end 18 of the debris removal apparatus 16, and quickly, easily and efficiently moves the pile of dust, debris and other material into a compartment within the debris removal apparatus 16 for holding and/or storing until emptied into a trash receptacle. In a preferred embodiment, the rotating brush 22 may be rotated via an onboard motor powered by the batteries.

Figure 2:
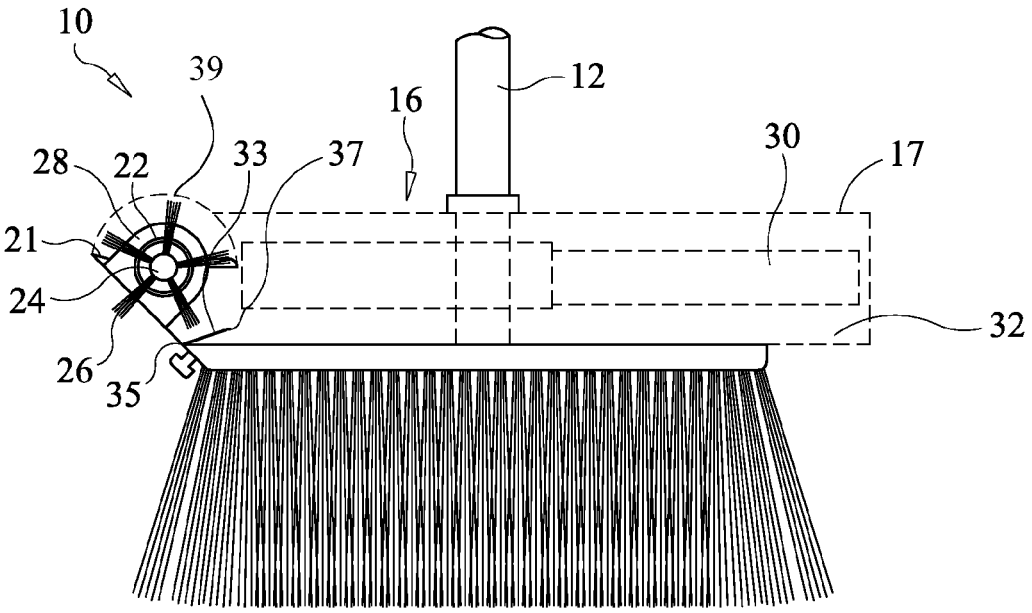
FIG. 2 illustrates a first side view of a debris removal apparatus and set of broom bristles in an embodiment of the present invention.

Referring now to FIG. 2, an internal representation of the debris removal apparatus 16 is illustrated from a first side. Specifically, the debris removal apparatus 16 is illustrated seated upon the set of bristles 14, and the handle 12 is shown disposed therethrough. The bristles may be attached to the bottom of the debris removal apparatus 16, such as via adhesive or by any other means apparent to one having ordinary skill in the art.

The debris removal apparatus 16, as illustrated in FIG. 2, may include rotating brush 22, comprising a rotating axle 24 having a plurality of brush bristles 26 thereon for moving dust, debris and other material when engaged. The rotating axle 24 may be interconnected with a motor box 28 which may, in turn, be interconnected with a power source 30, namely a battery pack. The motor box 28 may hold a motor and/or gear; however, the motor may be placed anywhere in the debris removal apparatus 16 so long as it is linked to the rotating axle 24 via a rotating shaft, gears or similar motor-stepping element known to one skilled in the art. In a preferred embodiment of the present invention, the battery pack comprises standard batteries, such as AA batteries or similar to minimize weight in the debris removal apparatus 16. Moreover, the power source 30, as represented by the battery pack in FIG. 2, may extend throughout the length of the debris removal apparatus 16 so as to balance the weight thereof within the debris removal apparatus 16. The motor box 28 may comprise a standard gear set for reducing the rotation of a motor contained therein so as to provide the rotating brush 22 with the desired rotation. Specifically, the rotation of the rotating brush 22 should be of sufficient rotational speed so that the brush bristles 26 are able to move the dust, debris and other materials into the debris removal apparatus 16.

A debris retaining compartment 32 is illustrated in FIG. 2. The debris retaining compartment may be separated from the power source such that the power source does not accumulate dust, debris or other materials. The debris retaining compartment 32 may retain the dust, debris and other materials that may be moved into the debris retaining compartment 32 via the rotating brush 22. The debris retaining compartment 32 may have a cover 17 disposed thereabove to retain the dust, debris and other material within the debris removal apparatus 16. The cover 17 may be removable to empty any collected dust, debris and other material into a trash receptacle, a bag or other place of disposal. Alternatively, a portion of the cover 17 may be openable to empty the same.

Figure 5:
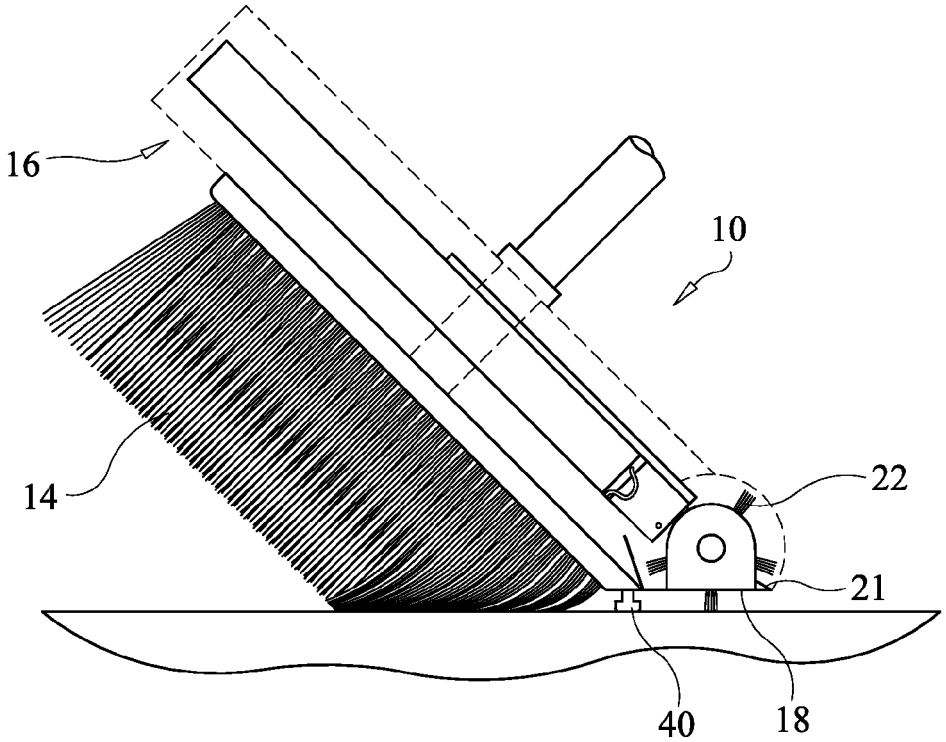
FIG. 5 illustrates the second side view of debris removal apparatus and broom bristles when in use in an embodiment of the present invention.
Figure 6:
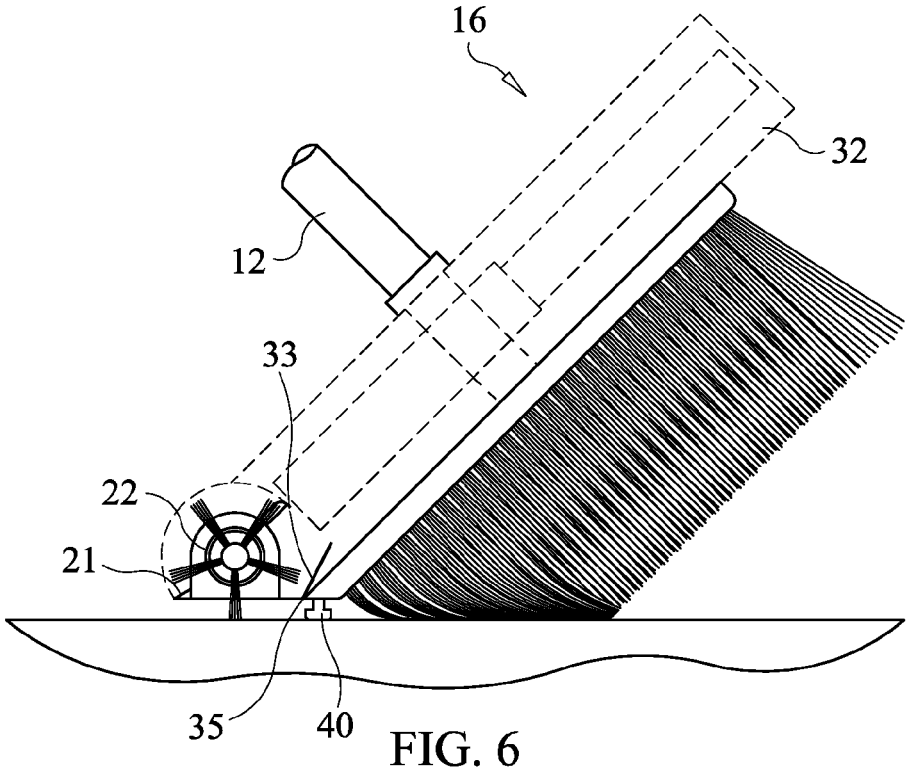
FIG. 6 illustrates the first side view of debris removal apparatus and broom bristles when in use in an embodiment of the present invention.

Positioned beneath the rotating brush 22 and adjacent the debris retaining compartment 32 may be a ramp 33 that may provide a surface for the dust, debris and other material to traverse when moved by the rotating brush 22. Specifically, the dust, debris and other material may traverse up the ramp 33 with sufficient force from the rotating brush 22 to enter the debris retaining compartment 32 disposed adjacent thereto. Specifically, this may occur when the broom apparatus 10 is tilted to a degree whereby the ramp 33 engages the floor or other surface, as illustrated in FIGS. 5 and 6, and discussed in more detail below. The ramp 33 may have a bottom edge 35 that may lay flat or flush against the floor or other surface when broom apparatus 10 is tilted to ensure that the dust, debris and other material traverses the ramp 33 and is retained by the debris retaining compartment 32, and is not pushed beneath the bottom edge 35 of the ramp 33.

Figure 4:
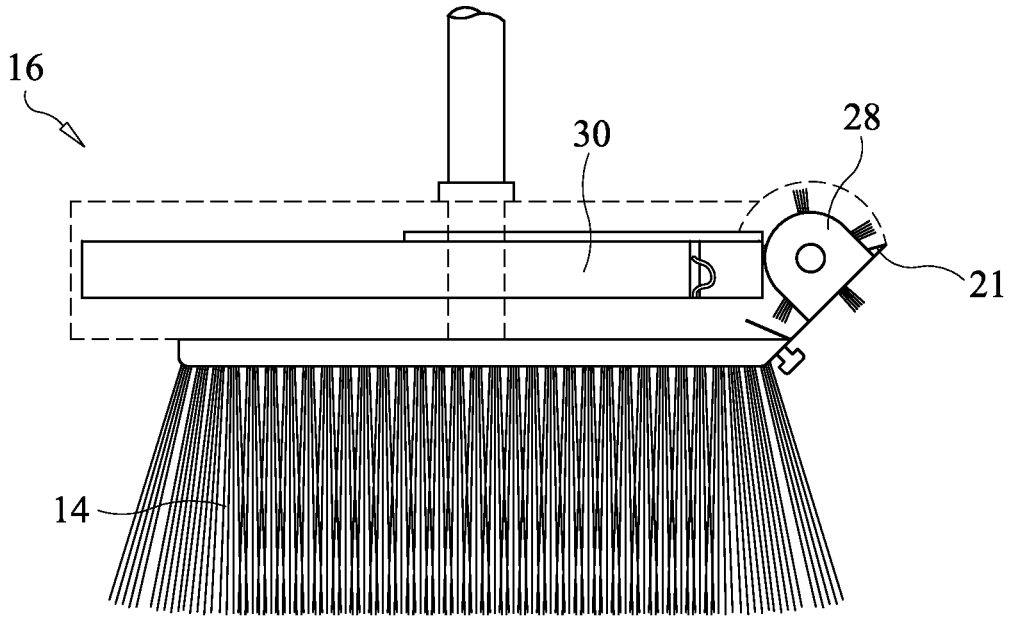
FIG. 4 illustrates a second side view of debris removal apparatus and broom bristles in an embodiment of the present invention.

While the ramp is illustrated at around a 25 degree angle relative to a bottom of the debris removal apparatus 16, as illustrated in FIGS. 2 and 4, and at around a 65 degree angle relative to the surface to be cleaned when tilted against the surface to be cleaned, as illustrated in FIGS. 5-6, the ramp 33 may be positioned at any angle that allows dust, debris and other material to traverse the ramp 33 and enter the debris retaining compartment 32 and prevents dust, debris and other material from escaping when the broom sweeper apparatus 10 is tilted, as described herein.

There may be a lip or wall 37 that may separate a top edge of the ramp 33 from the debris retaining compartment 32 that may ensure that dust, debris or other material that may be contained within the debris retaining compartment 32 remains within the debris retaining compartment 32, and does not fall out when the broom apparatus 10 is tilted, as illustrated in FIGS. 5 and 6. The lip or wall 37 may be sufficiently large to maintain the swept up dust, debris or other material contained within the debris retaining compartment 32.

A cover 39 may be disposed over and around the rotating brush 22 to ensure that dust, debris and other material is not flung away from the broom apparatus 10 when in use. The cover 39 may have an exit opening adjacent the debris retaining compartment 32 to ensure that the dust, debris and other material is moved into the debris retaining compartment 32. The cover 39 may have an entrance opening that may be placed against the floor or surface. A ridge 21 may be disposed at one end of the cover 39, such that the entrance opening extends from the ridge 21 to the bottom edge 35 of the ramp 33. The ridge 21 may partially interfere with the rotating brush 22 and may remove any remaining dust, debris or other material clinging to the rotating brush 22. The ridge 21 may also prevent dust, debris or other material from leaving the debris retaining compartment 32 or the cover 39.

The handle 12 may extend from a top of the debris removal apparatus 16. Specifically, the handle 12 may be permanently adhered or otherwise attached to the debris removal apparatus 16. Preferably, the handle 12 may have a thread on the end thereof, which may engage threads within a receptacle contained on the top of the debris removal apparatus 16 so that handle 12 may be added, removed, or changed, if desired. The debris retaining compartment 32 may be disposed around the handle 12 such that a portion of the handle is disposed within the debris retaining compartment 32. Alternatively, the handle 12 may clasp on top of the debris retaining compartment 32. The handle 12 may end in a "C" shaped bracket that may surround a midpoint of the debris retaining compartment 32. The "C" shaped bracket may hook, snap, or otherwise attach to the debris removal apparatus 16, so that the handle 12 may manipulate the same. Alternatively, the debris removal apparatus 16 may have hemispherical impressions disposed at a midpoint in the debris removal apparatus 16. The "C" shaped bracket on the handle may have matching hemispherical protrusions that may hook, snap, or otherwise fit in the hemispherical impressions in the debris removal apparatus 16. In this embodiment, the handle 12 may be rotatable about the hemispherical impressions. Of course, other rotatable handles known to one skilled in the art may be applied to the debris removal apparatus 16.

Figure 3:
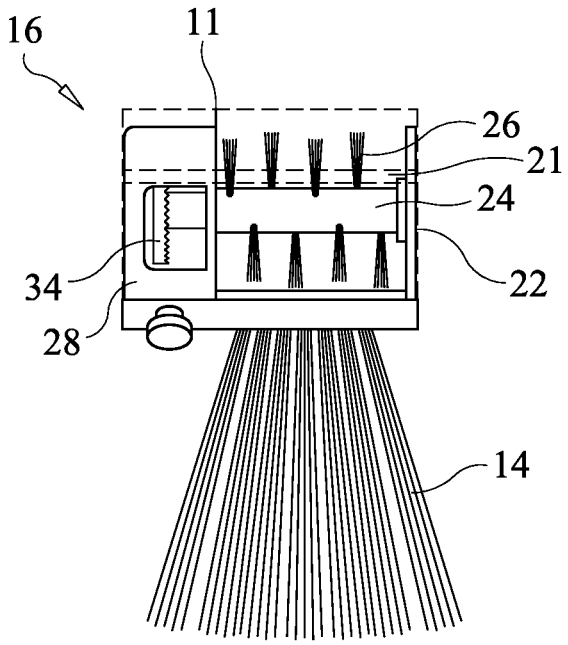
FIG. 3 illustrates a front view of debris removal apparatus and broom bristles in an embodiment of the present invention.

Referring now to FIG. 3, a front view of the debris removal apparatus 16 is illustrated interconnected with the set of bristles 14. The rotating brush 22 is illustrated having rotating axle 24 and brush bristles 26, which direct the dust, dirt and debris into debris retaining compartment 32. The axle 24 is illustrated interconnected with motor box 28, containing reducing gears 34 for achieving the desired rotational speed of the rotating brush 22.

As illustrated, the motor box 28 may provide a direct drive between a motor contained therein, via reducing gears 34, to rotate the axle 24 and brush bristles 26. An alternate drive system may be incorporated therein for driving the axle 24, such as via belts, gears, and other like devices useful for driving axle 24. The debris removal apparatus 16 may have a specific chamber for holding a power source separate from a debris retaining compartment, wherein the chamber is separated from the debris retaining compartment by the wall 11.

FIG. 4 illustrates a second side view of the debris removal apparatus 16 interconnected with the set of bristles 14. The motor box 28 may be interconnected to the power source 30, preferably the set of batteries, which may extend over the entirety of the debris removal apparatus 16.

Referring now to FIG. 5, a close-up view of the debris removal apparatus 16 is illustrated in use, showing how the same may be used to remove and retain dust, debris and other material that may be swept into a pile using the set of bristles 14. As shown in FIG. 5, the debris removal apparatus 16 may be tilted so that the first end 18 may generally touch the floor or other surface having the debris thereon. More specifically, the broom apparatus 10 may be tilted at approximately a 45 degree angle, although any angle may be utilized so long as the broom apparatus 10 operates as disclosed herein.

Once tilted, the motor contained within the motor box 28 may be activated. In a preferred embodiment, a switch 40 may be positioned on the first end 18, which may be switched when contacting the floor or other surface. Thus, the switch 40 may be positioned so that it only engages when in contact with the floor or other surface when the broom apparatus is tilted at the proper angle. Preferably, the switch 40 may be a momentary switch that activates the motor when engaged, and deactivates or otherwise cuts the power to the motor when no longer engaged with the floor or other surface. Thus, the motor may only be powered when desired, such as when the broom apparatus 10 is in the proper position/tilt to remove and retain the dust, debris and other material. Specifically, the switch 40 may be positioned to only activate at an angle that maximizes the removal of dust, debris and other material. The user, therefore, does not have to determine what angle to hold the broom apparatus 10 at to maximize picking up of dust, debris and other material because the angle has been predetermined. The switch 40 may combine turning the broom apparatus 10 on or off with adjusting the broom apparatus 10 to pick up dust, debris and other material. Additionally, the user may save energy by only powering the motor at a specific time and angle instead of having the device on for a prolonged period of time. Although not shown in the figures, the switch 40 may be recessed into the broom apparatus 10 such that the first side 18 of the broom apparatus may be flush with the floor or surface.

Alternatively, the switch may be activated merely by the tilt of the broom apparatus 10, such as via an accelerometer, a gyroscopic device, a magnetic switch or any other switch apparent to one of ordinary skill in the art. The motor within the motor box 28 may therefore turn on upon a specific tilt of the broom apparatus 10 without engaging a switch of any kind. This may allow a user to effortlessly sweep up dust, debris and other like material without forcing the broom apparatus 10 towards the floor or surface.

When tilted, to engage the switch 40, it is preferable that the set of bristles 14 be flexible enough to be pushed out of the way to engage the switch 40 and utilize the rotating brush 22 to remove the pile of dust, debris and other material, as illustrated in FIGS. 5 and 6. Specifically, a user of the broom apparatus 10 may apply sufficient force against the ground when in a tilted position to ensure proper positioning of the broom apparatus, including ensuring that the set of bristles 14 is out of the way, and engagement of the switch 40 when desired.

FIG. 6 illustrates the first side view of the debris removal apparatus 16 in use, which may preferably be tilted by the user grasping the handle 12 and pushing the same against the floor or other surface. Once tilted and in the proper position, the switch 40 may engage, activating the motor and rotating the rotating brush 22. The rotating brush 22 may therefore move the pile of dust, debris and other material into the debris retaining compartment 32, as described above.

FIG. 6 further illustrates the ramp 33 and, specifically, the bottom edge 35 thereof that may be pressed against the floor or other surface to ensure that dust, debris and other material does not become pushed under the ramp 33.

Therefore, as described herein, a user may, in a preferred embodiment, utilize the broom apparatus 10 to sweep dust, debris and other material using the set of bristles like a normal broom, and actively pick up the pile of dust, debris and other material without requiring a dustpan, a vacuum, and a separate electric sweeper to do so. A user of the present invention can utilize the single unit of the broom apparatus 10 to completely remove the dust, debris and other material in a quick, easy and efficient manner.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A sweeper apparatus comprising:

a base having a length and a width the base having a first side and a second side on opposite ends of the length of the base and a plurality of broom bristles extending from a bottom of the base for sweeping material into a pile; the plurality of bristles arranged in a line from the first side to the second side over the length of the base; and a debris collection mechanism disposed on a top of the base, comprising at least one rotatable brush disposed on a first end of the base and a material retaining compartment disposed adjacent the at least one rotatable brush; the rotatable brush having an axis of rotation that is perpendicular to the line on which the plurality of the broom bristles are arranged, wherein engagement of the at least one rotatable brush to a surface allows the at least one rotatable brush to move material into the material retaining compartment.

2. The sweeper apparatus of claim 1 further comprising a handle detachably connected to the top of the base.

3. The sweeper apparatus of claim 2 wherein the handle is rotatable.

4. The sweeper apparatus of claim 1 wherein the at least one rotatable brush is operated by a motor.

5. The sweeper apparatus of claim 4 wherein the motor is powered by batteries.

6. The sweeper apparatus of claim 4 further comprising a motor switch disposed on the debris collection mechanism that operates the motor when the motor switch contacts the surface.

7. The sweeper apparatus of claim 6 further comprising a motor switch disposed on the debris collection mechanism that initiates the motor when the motor switch is angled towards the surface.

8. The sweeper apparatus of claim 1 further comprising a ramp disposed beneath the at least one rotatable brush.

9. The sweeper apparatus of claim 8 wherein the ramp is capable of contacting the surface and directing the material into the material retaining compartment.

10. The sweeper apparatus of claim 8 wherein the ramp is capable of preventing material from leaving the material retaining compartment.

11. The sweeper apparatus of claim 1 further comprising a cover disposed around the at least one rotatable brush.

12. The sweeper apparatus of claim 11 wherein the cover comprises an entrance, an exit, and an interfering ridge extending inwardly from one end of the entrance that partially impedes the rotation of the at least one rotatable brush.

13. The sweeper apparatus of claim 1 further comprising an openable cover that encloses the material retaining compartment.

14. A method of cleaning, the method comprising the steps of:

providing a sweeper apparatus having a base with a plurality of bristles extending from a bottom of the base, and a debris collection mechanism disposed on a top of the base, comprising at least one rotatable brush disposed on a first end of the base and a material retaining compartment disposed adjacent the at least one rotatable brush, wherein the at least one rotatable brush is operated by a motor that initiates when a switch contacts a surface;

providing material;

sweeping the material with the plurality of bristles to a location on a surface;

positioning the at least one rotatable brush atop the location.

contacting the surface with the switch; and moving the at least one rotatable brush along the surface, such that the material is moved into the material retaining compartment by the at least one rotatable brush.

15. The method of claim 14 further comprising the step of:

using the at least one rotatable brush to move the material into the material retaining compartment.

16. The method of claim 14 wherein the at least one rotatable brush is operated by a motor that initiates when angled toward the surface, further comprising the steps of:

angling the debris collection mechanism toward the surface; and moving the at least one rotatable brush along the surface, such that the material is moved into the material retaining compartment by the at least one rotatable brush.

17. The method of claim 14 wherein the material retaining compartment is openably enclosed, further comprising the steps of:

opening the material retaining compartment; and emptying the material retaining compartment.

18. The method of claim 14 wherein the sweeper apparatus further comprises a detachable handle, further comprising the steps of:

attaching the detachable handle to the base of the sweeper apparatus; and using the handle to manipulate the sweeper apparatus.

19. The method of claim 18 wherein the detachable handle is rotatable, further comprising the step of:

rotating the handle.

20. A sweeper apparatus comprising:

a base having a plurality of bristles extending from a bottom of the base for sweeping material into a pile;

a debris collection mechanism disposed on a top of the base, comprising at least one rotatable brush operated by a motor disposed on a first end of the base and a material retaining compartment disposed adjacent the at least one rotatable brush; and a motor switch disposed on the debris collection mechanism that operates the motor when the motor switch contacts the surface, wherein engagement of the at least one rotatable brush to a surface allows the at least one rotatable brush to move material into the material retaining compartment.

* * * * *